United States Patent [19]

Kolthoff, Jr.

[11] 3,990,504

[45] Nov. 9, 1976

[54] TWO STAGE OPERATION FOR RADIATOR

[75] Inventor: C. Paul Kolthoff, Jr., Naperville, Ill.

[73] Assignee: International Harvester Company, Chicago, Ill.

[22] Filed: Sept. 29, 1975

[21] Appl. No.: 617,478

[52] U.S. Cl. ..... 165/40; 123/41.08; 165/97

[51] Int. Cl.[2] ..... F28F 27/02

[58] Field of Search .....165/28, 40, 34, 35, 165/102, 103, 97; 123/41.02, 41.08, 41.09, 41.1

[56] References Cited

UNITED STATES PATENTS

| | | | |
|---|---|---|---|
| 1,551,076 | 8/1925 | Thill | 165/97 |
| 1,558,009 | 10/1925 | Giesler | 123/41.1 |
| 1,809,538 | 6/1931 | Weisshaar | 165/102 |
| 2,487,484 | 11/1949 | Simpelaar | 165/97 |
| 2,649,698 | 8/1953 | Goldmann | 165/97 X |

FOREIGN PATENTS OR APPLICATIONS

| | | | |
|---|---|---|---|
| 10,690 | 6/1895 | Switzerland | 165/102 |
| 460,047 | 1/1937 | United Kingdom | 165/38 |

*Primary Examiner*—Albert W. Davis, Jr.
*Assistant Examiner*—Sheldon Richter
*Attorney, Agent, or Firm*—John P. O'Brien; Floyd B. Harman

[57] ABSTRACT

The invention disclosed in this application relates to an improvement in a water cooling system for an engine of the type that passes air and water through the radiator at relatively low flow rates whenever the engine is running in its low idle speed condition. The radiator is disclosed as having upper and lower headers interconnected by a plurality of parallel extending rows of water tubes. A means responsive to the engine speed is provided for converting the water flow through the water tubes from a plurality of parallel paths to a single series path upon the engine speed dropping to its low idle speed condition.

8 Claims, 2 Drawing Figures

TWO STAGE OPERATION FOR RADIATOR

BACKGROUND OF THE INVENTION

This invention relates to an improved radiator construction, and in particular to an improved means of cooling the water when the engine is operating in its low idle speed condition.

In conventional radiator constructions the water tubes extend parallel between the upper and lower headers and the water drops from the upper header in parallel paths through rows of water tubes to the lower header. In these conventional radiators both the water flow and air flow through the radiator core section are quite high under a maximum power condition to provide the necessary cooling. However, when the engine is operating in a prolonged low idle condition, the water and air flow are greatly reduced, and as a consequence the heat rejection rate is not sufficient to maintain the water within the normal operating temperature range.

This invention overcomes the above-mentioned deficiency of conventional radiators when operating in the low idle speed condition by converting the water flow in the radiator core section from several parallel paths to a single series flow to thereby expose the water flowing through the radiator to a much longer cooling period. In the low idle speed condition the water flow velocities in the tubes are increased providing turbulent flow which has greater heat transfer than the laminar flow at lower velocities.

In the prior art there are many patents that disclose the use of an adjustable internal baffle for selectively restricting the flow in certain portions of the radiator, but most of these patents are concerned with preventing freezing during the warm-up period of the engine, such as disclosed by U.S. Pat. No. 1,000,259 to Hager and U.S. Pat. No. 1,330,342 to Prell. Likewise, U.S. Pat. No. 2,023,920 to Eisinger et al and Young U.S. Pat. No. 2,164,605 show the use of a temperature responsive gating means responsive to provide a bypass to prevent the cooling liquid from passing through the finned tubes until a desired high temperature is reached. Other prior art patents show the use of valving means to selectively cause the flow to either pass in parallel streams or in series through several tubes, such as disclosed in U.S. Pat. No. 2,487,484 to Simpelaar. However, none of the prior art patents disclose the concept of converting the flow of the cooled liquid from parallel paths to a series path in response to the engine speed dropping to a low idle condition.

SUMMARY OF THE INVENTION

This invention is directed to an improvement in a water cooling system for an engine of the type that greatly reduces the air and water flow rates passing through the radiator when the engine is running in a low idle condition. The radiator is constructed of upper and lower headers interconnected by a plurality of parallel extending rows of water tubes formed in its core section through which the cooled liquid normally passes in parallel paths. My invention comprises a gate means provided in the upper and lower headers which converts the water flow from multiple parallel paths to a single series path upon the engine speed dropping to its low idle condition.

DESCRIPTION OF THE DRAWING

For a better understanding of this invention, reference may be made to the accompanying drawing in which.

DESCRIPTION OF THE PREFERRED EMBODIMENT

Figure 1:
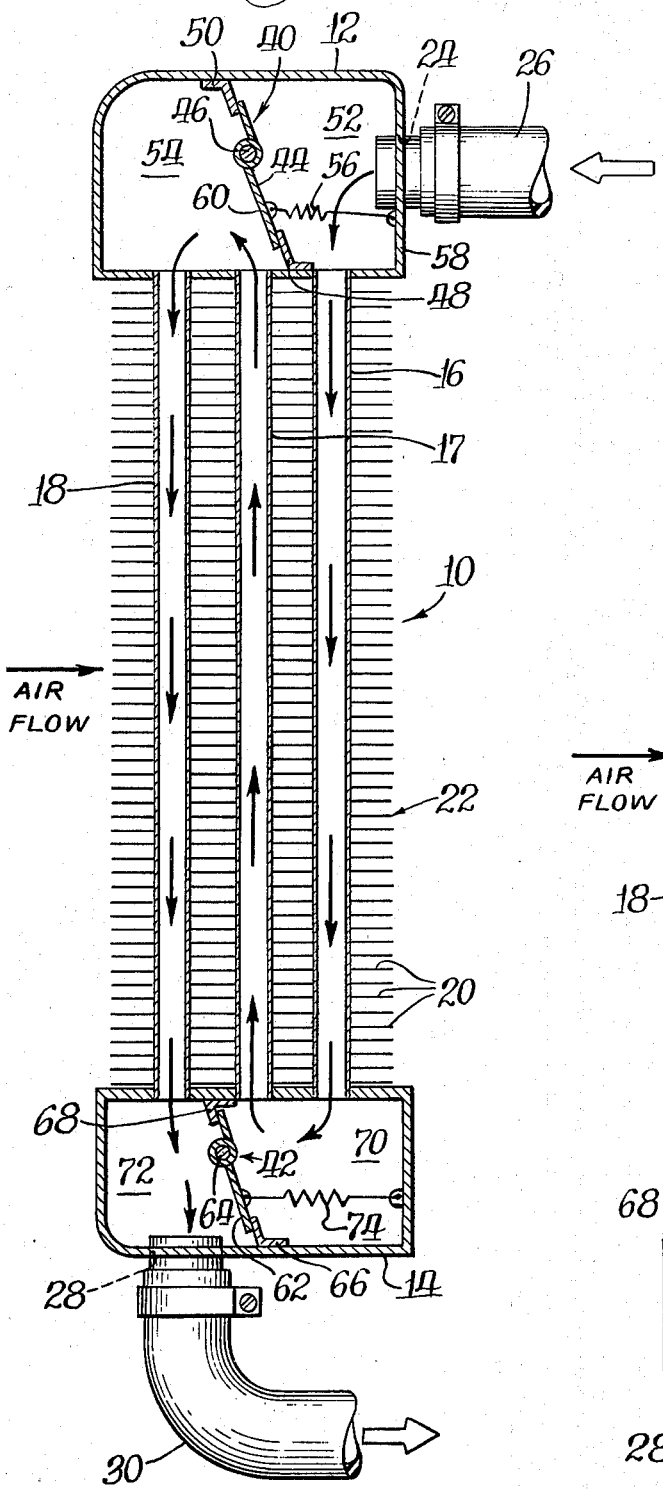
FIG. 1 is a cross sectional view of a radiator embodying the principles of my invention in which the gate means are shown in the closed position to provide a series flow path through the water tubes.

Referring to the drawing there is shown a radiator, generally referred to by the reference numeral 10 and of the type that is normally used to cool an internal combustion engine. Radiator 10 is constructed of an upper header 12 and a lower header 14 whose interior chambers are in communication with three parallel extending rows of water tubes 16, 17, and 18. These three rows of water tubes are held in their parallel relationship by the finned structure 20 to define a conventional core section 22.

As is conventional, the upper header 12 is formed with an inlet opening 24 for receiving the end of flexible tubing 26 that returns the water from the engine. Likewise the lower header 14 is provided with an outlet opening 28 for receiving flexible tubing 30 which returns the cooled water to the engine.

Figure 2:
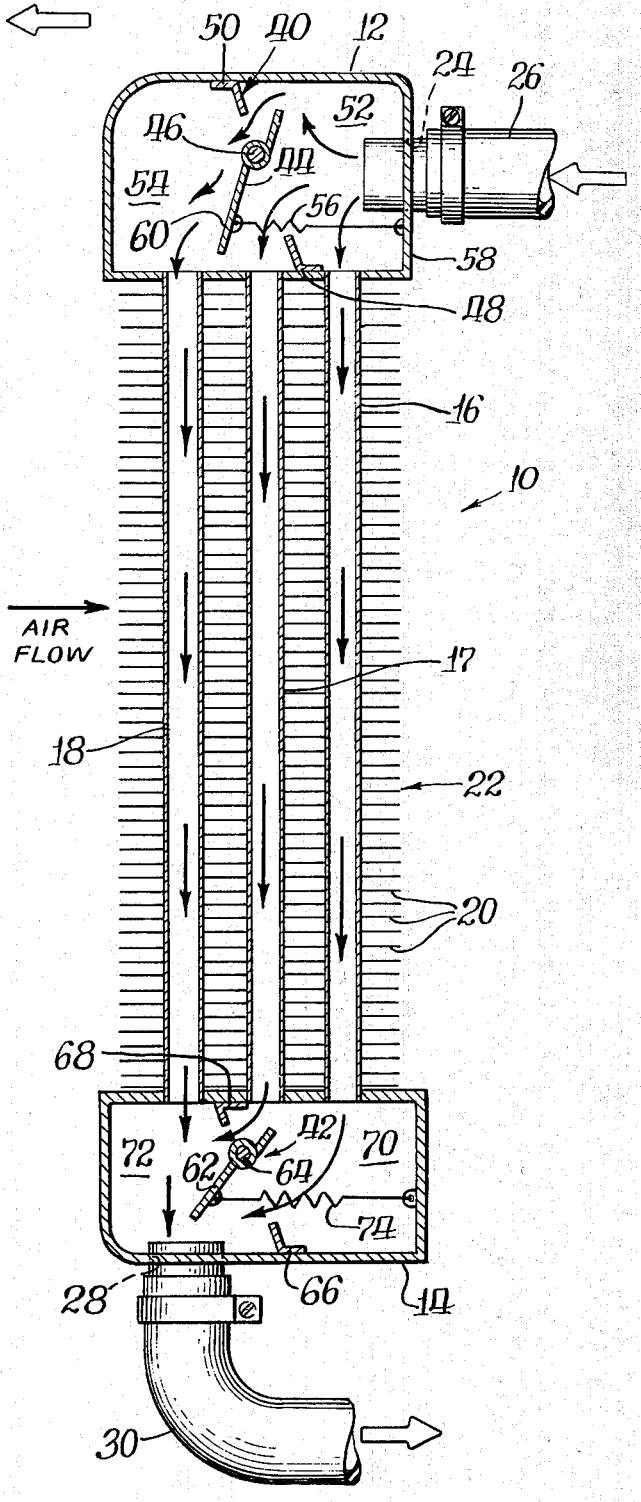
FIG. 2 is a cross sectional view identical to FIG. 1 with the exception that the gate means is shown in the open position causing the water to flow in parallel paths through the water tubes.

In a conventional water cooling system the heated water entering upper header 12 from the return tubing 26 passes down through the three rows of water tubes 16, 17, and 18 in parallel paths as depicted in FIG. 2, and the fins 20 conduct the heat away from the water passing through the water tubes to cool the liquid. To provide further cooling most water-cooled systems include a fan (not shown) placed directly in front of the core section 22 that passes air across the fins to accelerate the heat transfer away from the rows of water tubes 16–18.

As previously mentioned the water flow through the water cooled system and the speed of the fan are directly proportional to the output speed of the engine, and as a consequence in the low idle speed condition of the engine these flow rates are so reduced that sufficient cooling is not provided over a prolonged period of time and the engine will turn to overheat. This invention overcomes the overheating problem when operating in the low idle condition by providing gate means 40 and 42 in the upper and lower headers 12 and 14 respectively, for converting the parallel flow through the water tubes to a single series path upon the occurrence of the low idle condition of the engine.

Gate means 40 is depicted as a baffle 44 pivotally mounted on a pin 46 secured between the ends of the header 12 and cooperating with a pair of longitudinally extending flanges 48 and 50 that divide the upper header 12 into two chambers 52 and 54 when baffle 44 is in the closed position of FIG. 1. To urge the baffle 44 to this closed position a spring 56 is stretched between the side 58 adjacent inlet opening 24 and long arm 60 of baffle 44. The spring constant of spring 56 is selected so that baffle 44 is held in the closed position during the low water pressure condition caused when the engine speed drops to the low idle condition.

Likewise the gate means 42 is constructed of a baffle 62 pivotally mounted on a pin 64 and disposed in the lower header 14 in a manner to cooperate with a pair of longitudinally extending flanges 66 and 68 to divide the lower header 14 into two separate chambers 70 and 72 when the baffle is in the closed condition. Similarly, spring 74 is provided to constantly urge the baffle 62 into a closed position, and its spring constant is selected so that the baffle 62 will remain in the closed condition during the low water pressure condition caused by the engine dropping to the low idle condition.

From the above description it will now be understood that this invention provides a two-stage operating radiator. In the first stage when the engine is operating under full power the water pressure at water inlet 24 is of sufficient magnitude to overcome the opposing spring force of springs 56 and 74 to hold baffles 44 and 62 in their open positions causing the water to flow in parallel paths down through the three rows of water tubes 16, 17, and 18 as depicted in FIG. 2.

When the engine speed drops to an idle condition, the water pressure of the liquid coming from the engine is greatly reduced and of such a small quantity to permit springs 56 and 74 to pull the baffles 44 and 62, respectively, to the closed position of FIG. 1. In this closed position the water coming into chamber 52 is directed downwardly through water tube 16 into chamber 70 and from there it passes up into chamber 54 where it once again drops down to chamber 72 and exits from the radiator through outlet opening 28. It will be appreciated from referring to FIG. 1 that the path of the water through the radiator water tubes in the low idle condition is a single series path which is three times as long as a parallel path thus increasing the heat transfer capabilities of the radiator core section 22 by a substantial margin. It is noteworthy that the hottest water (entering from the engine) is cooled by the heated air leaving the radiator, and that the coolest air cools the water adjacent the radiator's outlet opening 28. It is also significant that the water flow velocities in the tubes increase in the low idle condition which produces a turbulent flow that has greater heat transfer than laminar low at low water flow velocities. Another advantage of this invention is that the heat exchanger is converted from a single-pass to a counterflow multipass design, which has greater heat transfer effectiveness.

Although the baffle arrangement depicted in the drawings is undoubtedly the simplest and most economical means of converting the radiator to a single series path flow, other activating means could be used to open the baffles such as a solenoid operated plunger or a temperature responsive element.

What is claimed is:

1. An improvement in a water cooling system for an engine of the type that passes air and water through the radiator at relatively low flow rates when said engine is running in its low idle speed condition, said radiator comprising an upper header and a lower header interconnected by a plurality of parallel extending rows of water tubes in a core section, said improvement comprising means responsive to said engine speed for converting the water flow through said water tubes from parallel paths to a series path upon the occurrences of said engine changing to said low idle speed condition.

2. An improvement as defined in claim 1, wherein said engine speed responsive means includes a first baffle having open and closed positions pivotally mounted to said upper header adjacent to the radiator inlet opening in a manner that said first baffle in said closed position divides said upper header into two upper chambers, one of said upper chambers being in direct communication with said inlet opening and one of said rows of water tubes, a second baffle having open and closed positions pivotally mounted in said lower header adjacent to the radiator outlet opening in a manner that said second baffle in said closed position divides said lower header into two lower chambers, one of said lower chambers being in direct communication with said exit opening and the row of water tubes farthest apart from said one row of water tubes.

3. An improvement as defined in claim 2, wherein said engine speed responsive means further comprises spring bias means for holding said first and second baffles in said closed positions during said low idle speed condition of said motor.

4. An improvement in a water cooling system for an engine of the type that passes water through the radiator at relatively low flow rates when said engine is running in its low idle condition, said radiator comprising an upper header and a lower header interconnected by a plurality of parallel extending rows of water tubes in a core section, said improvement comprising a gate means provided in said upper and lower headers between adjacent rows of water tubes for converting the water flow through said water tubes from parallel paths to a series path upon the occurrence of said engine changing to said low idle condition.

5. An improvement as defined in claim 4, wherein each of said gate means comprises a pivotally mounted baffle having open and closed positions, which when in said closed position blocks the flow of water in said headers between said adjacent rows of water tubes.

6. An improvement as defined in claim 5, wherein said gate means further comprises spring bias means for holding each of said baffles in said closed position during said relatively low flow rate of the water through the radiator.

7. An improvement in a water cooling system for an engine of the type that passes water through the radiator at relatively low flow rates when said engine is running in its low idle condition, said radiator comprising an upper header having an inlet opening, a lower header having an outlet opening, and three parallel extending rows of water tubes in a core section interconnecting said upper and lower headers, the first row of said water tubes being closest to said inlet opening and the third of said rows of water tubes being closest to said outlet opening, said improvement comprising a first gate means having open and closed positions disposed in said upper header between said first and second water tubes which divides said upper header into two chambers when in said closed position and a second gate means having open and closed positions disposed in said lower header between said second and third rows of water tubes which divides said lower chamber into two chambers when in said closed position, said first and second gate means being responsive to water pressure such that when said radiator water flow rate drops sufficiently the water flow through said rows of three tubes is converted from three parallel paths to a single series path.

8. An improvement as defined in claim 7, wherein said first and second gate means each comprises a baffle pivotally mounted in a manner to divide said header into said two chambers in said closed position, and a spring means for urging said baffle to swing against the normal flow direction to said closed position.

* * * * *